US006070380A

United States Patent [19]

Meilleur

[11] Patent Number: 6,070,380

[45] Date of Patent: Jun. 6, 2000

[54] CONCRETE WALL FORMWORK MODULE

[76] Inventor: Serge Meilleur, 348, D'Iberville, Varennes, Quebec, Canada, J3X 1T9

[21] Appl. No.: 09/238,292

[22] Filed: Jan. 28, 1999

[51] Int. Cl.[7] ..... E04C 2/34; E04B 2/28

[52] U.S. Cl. ..... 52/309.7; 52/309.11; 52/426; 52/431; 52/439; 52/592.6; 52/600; 52/606

[58] Field of Search ..... 52/309.7, 309.11, 52/309.12, 309.16, 426, 431, 439, 583.1, 591.4, 592.6, 600, 606

[56] References Cited

U.S. PATENT DOCUMENTS 4,516,372 5/1985 Grutsch .
4,604,843 8/1986 Ott et al. .
4,773,199 9/1988 Kohara ..... 52/426
4,888,931 12/1989 Meilleur .
5,487,248 1/1996 Artzer ..... 52/309.12
5,771,648 6/1998 Miller et al. ..... 52/426 X
6,000,194 12/1999 Nakamura ..... 52/309.12 X

*Primary Examiner*—Christopher T. Kent
*Attorney, Agent, or Firm*—Collard & Roe, PC

[57] ABSTRACT

Disclosed is a prefabricated concrete formwork module that may be assembled with others similar modules in the manner of a brick wall to form a mold into which concrete is poured. The formwork module has a reinforcing structure preferably made of parallel grids connected by transverse tie-rods. It also has a pair of opposite panels forming spaced apart longitudinal side-walls. It further has arms defining a bridge for providing stability between adjacent modules when assembled to form a wall. Preferably, the panels are made of an insulating material.

20 Claims, 10 Drawing Sheets

CONCRETE WALL FORMWORK MODULE

BACKGROUND OF THE INVENTION

1) Field of the Invention

The present invention relates to concrete forms. More particularly, the invention relates to a prefabricated concrete formwork module that can be assembled with other identical modules like a brick wall to form a mold into which concrete is poured. Once assembled and filled with concrete, the modules are left in place thereby providing a concrete wall with panels on both of its sides.

2) Description of the Prior Art

U.S. Pat. No. 4,888,931 in the name of the present inventor discloses an insulating formwork for casting a concrete wall, which is made of foam panels connectable to each other in parallel relationship by means of tie-rods. Once assembled, the panels define a concrete framework into which concrete can be poured. U.S. Pat. No. 4,604,843 also discloses a formwork for casting a concrete wall, which is made of insulating slabs of foam material reinforced by a metal core. The slabs are connectable to each other in parallel relationship by means of horizontal elements having a ladder like configuration.

In both cases, the formworks must be assembled on the premises, thereby requiring time and manual dexterity.

U.S. Pat. No. 4,516,372 discloses a concrete formwork made of modules each comprising two parallel spaced apart panels preferably made of insulating foam. Each module also comprises backing plates extending on the external surfaces of the panels. These plates are connected to each other by means of tier-rods extending through the panels. This patent does not disclose or suggest that reinforcing cores or grids be embodied into the panels. It does not disclose or suggest either that a concrete reinforcing structure such as rods or grids be part of each module and be permanently positioned between the panel of the module to be embodied with the concrete and thus to reinforce the same when it is cast.

In view of the above, it is clear that there is a need for a one-piece prefabricated formwork module that can be easily and rapidly assembled with other similar modules in order to form a reinforced concrete wall formwork. The purpose of this invention is to fulfil this need along with other needs that will be apparent to those skilled in the art upon reading the following specification.

SUMMARY OF THE INVENTION

It is an object of the invention to provide a one piece prefabricated formwork module that may easily be assembled with similar modules for forming a reinforced concrete wall formwork.

The module of the invention comprises a reinforcing structure, a pair of opposite panels forming spaced apart longitudinal side-walls and bridging means for providing stability between the module and other similar modules adjacent to it when assembled to form a wall.

The reinforcing structure comprises at least three and preferably four metal grids extending in parallel vertical relationship. The grids are spaced apart from each other with two of the grids extending externally, every other grid extending inwardly between the externally extending grids. A plurality of tie-rods extending transversely to the grids rigidly connect to each other and altogether the grids so as to form a unitary structure The panels extend in parallel vertical planes. Each panel embodies one of the two externally extending grids and forms therewith a longitudinal side-wall. The panels are thus spaced apart and facing each other in parallel relationship.

The bridging means are rigidly connected to the reinforcing structure and they project upwardly above the panels in order to co-operate with the reinforcing structure of a similar module stacked upon the module.

In a preferred embodiment, the bridging means comprises arms rigidly connected to at least one of the inwardly extending grids for providing horizontal and vertical stability between the modules when assembled to form a wall. The arms defines a U-shaped trough sized and positioned to engage in a tight-fit manner with at least one of the inwardly extending grids of the similar vertically stacked module.

As aforesaid, the formwork module preferably comprises two inwardly extending grids and the bridging means comprises a junction grid rigidly connected to each of the two inwardly extending grids. The junction grids incorporate the arms and project upwardly above the panels so as to define the U-shaped though which is thus sized and positioned to engage in a tight-fit manner the inwardly extending grids of the similar vertically stacked module.

In another embodiment of the invention, the concrete wall formwork module further comprises joining means rigidly connected to the reinforcing structure and projecting horizontally away from the panels. The joining means co-operate with the reinforcing structure of a similar adjacent module and provide an additional stability between the modules when assembled to form a wall.

It is another object of the invention to provide a formwork module having a high insulating ability. In accordance with the invention, this object is achieved by using a module as described hereinabove wherein at least one, and preferably both of the panels are made of a low density plastic foam having a high insulating ability, such as polyurethane or polystyrene.

The prefabricated formwork module of the invention may thus rapidly and easily be assembled with other similar modules to form a reinforced concrete wall formwork. Once assembled and filled with concrete, the modules are left in place thereby providing a concrete wall with panels on both of its sides. Since the panels are preferably made of insulating material, the resulting concrete wall is insulated both on the inside and the outside.

Other objects and features of the invention will become apparent upon reading the following, non restrictive description of several preferred embodiments thereof, made with reference to the appended drawings.

DESCRIPTION OF SEVERAL PREFERRED EMBODIMENTS OF THE INVENTION

Figure 1A:
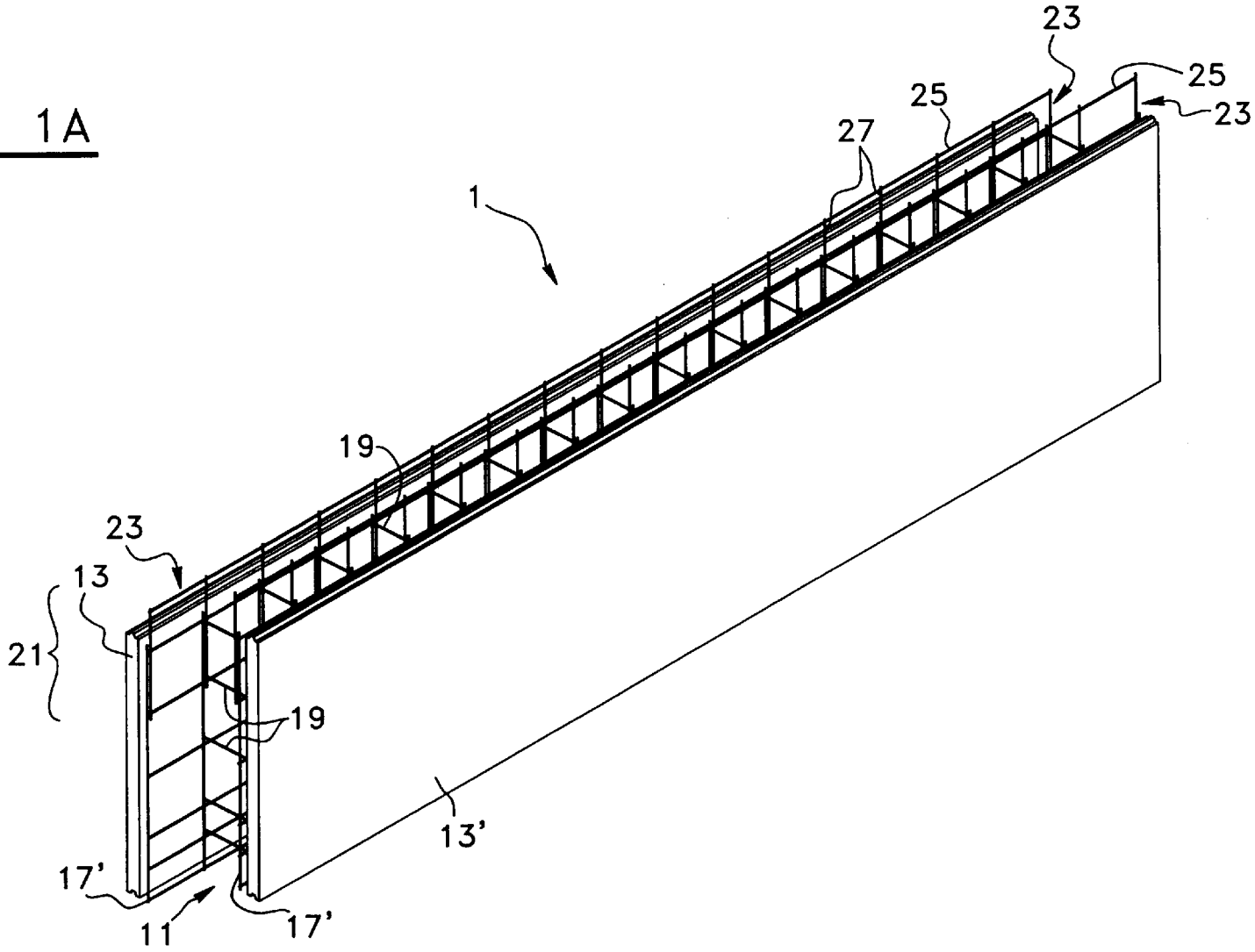
FIG. 1A is a top perspective view of a formwork module according to a first preferred embodiment of the invention, the module having a reinforcing structure with two inwardly extending parallel grids.
Figure 1C:
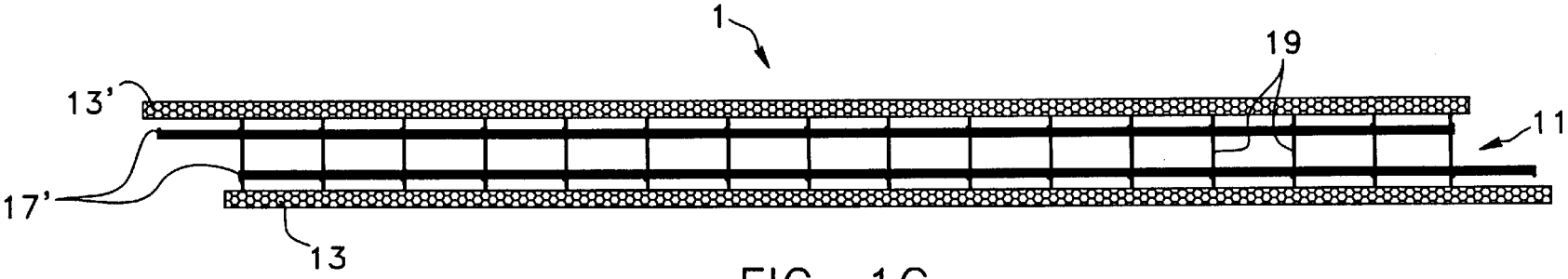
FIG. 1C is a top plan view of the module shown in FIG. 1A.
Figure 1B:
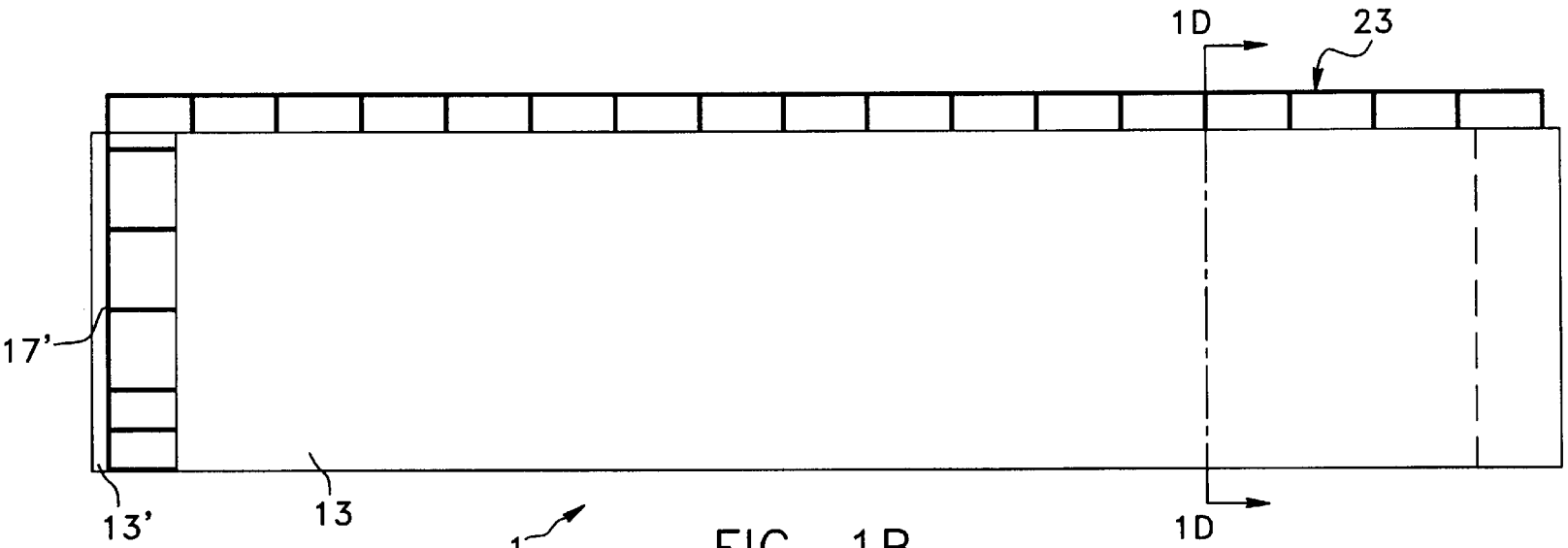
FIG. 1B is a front elevation view of the module shown in FIG. 1A.

FIGS. 1A, 1B, 1C and 1D illustrate a module 1 according to a first preferred embodiment of the present invention. As can be seen, the module 1 is prefabricated and comprises:

a) a reinforcing structure 11;

b) a pair of opposite panels 13, 13' forming spaced apart longitudinal side-walls; and c) bridging means 21 for providing stability between the module 1 and adjacent similar or identical modules when assembled to form a wall.

The expression "similar or identical module" is used herein to make it clear that the adjacent modules may be entirely but not necessarily identical in shape and size. In all cases, their width should be identical but their length and height could be varied as needed.

The reinforcing structure 11 comprises four rows of metal grids 17, 17' which extend in parallel vertical relationship. The grids 17, 17' are spaced apart from each others. Two of the grids, viz. those numbered 17, extend externally, whereas the two other grids numbered 17' extend inwardly between the externally extending grids 17. A plurality of tie-rods 19 extend transversely to the grids 17, 17' and rigidly connect to each other and altogether the grids 17, 17' thereby forming a unitary structure. As is illustrated, the grids 17, 17' preferably are identical in length and horizontally offset in pairs.

The panels 13, 13' extend in parallel vertical planes, with each of the panels 13, 13' embodying one of the two externally extending grids 17. Each of the panels 13, 13' form a longitudinal side-wall. The so-formed side walls are spaced apart and face each other in parallel relationship. During the manufacture of the module 1, the panels 13, 13' are cast onto the two externally extending grids 17 that are parts of the reinforcing structure 11. The inwardly extending grids 17', which have as a function to reinforce the concrete wall, are preferably at a distance of from ⅝ to ¾ inch of the closest panel.

Preferably, each panel has a length varying from about 4 feet to about 10 feet, and a height length varying from about 1 foot to about 10 feet. More preferably the panels are 8 feet long and 2 feet high. Preferably also the panels 13, 13' are horizontally offset with respect to each other. Therefore, when two similar modules are assembled in line end to end, there is no facing joint. Furthermore, modules having offset panels may be aligned perpendicularly with respect to each other to form a corner.

In order to provide a formwork module having a high insulating ability, the panels 13, 13' are preferably made of a low density plastic foam having a high insulating ability such as polyurethane or polystyrene. The thickness of such foam panels may vary from about 1 inch to about 4 inches. More preferably, each panel is about 1½ inch thick.

In the illustrated embodiment of FIGS. 1A to 1D, the externally extending grids 17 are fully embodied into the panels 13,13', thereby forming cores within the panels 13, 13'. Such an isolated core reduces to a minimum extent the thermal conduction from the external side of the module to the opposite internal side through the metal reinforcing structure. However, the panels 13, 13' may also be cast such that one or both of the externally extending grids 17 are protruding partially or entirely to the external surface of the corresponding panel(s), thereby providing an external rough surface to the panel(s).

Figure 1D:
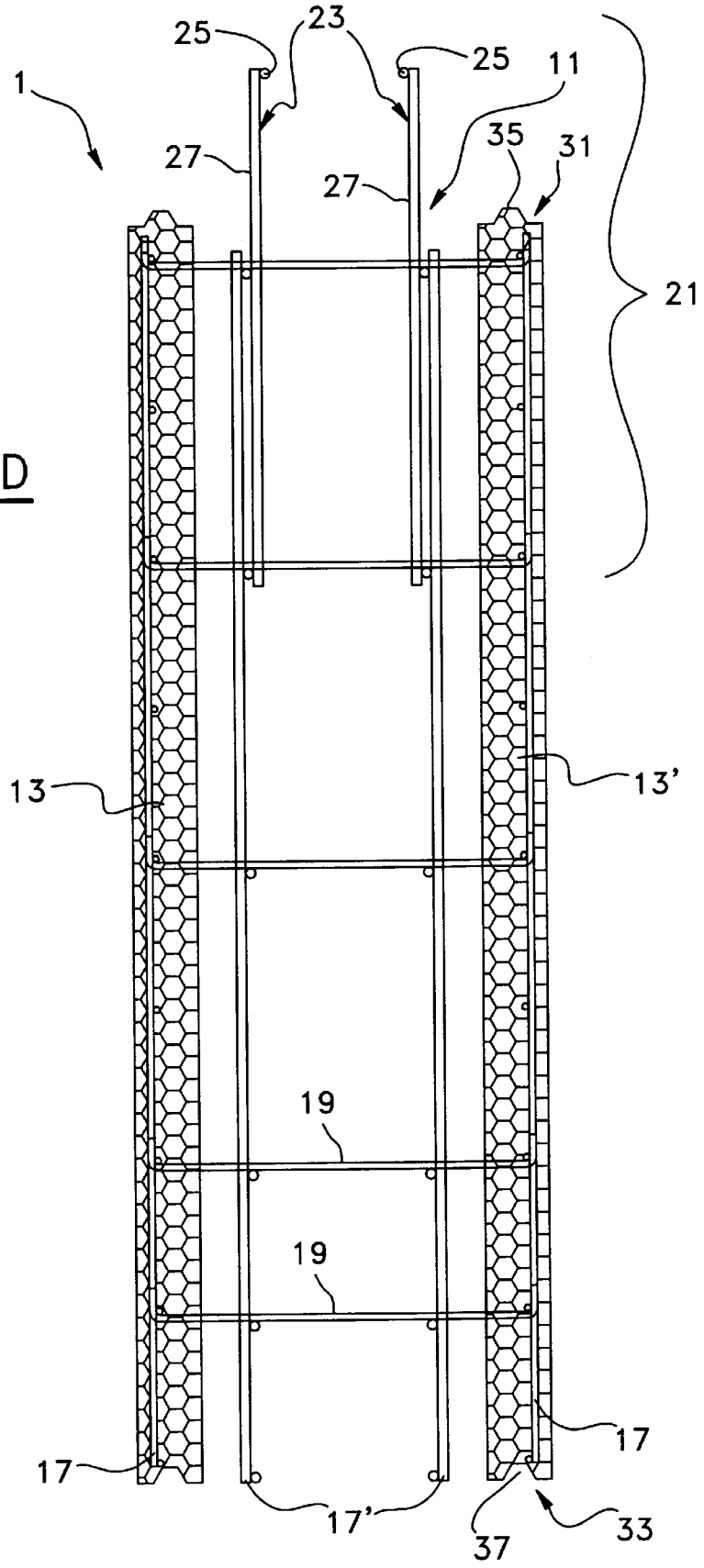
FIG. 1D is a side elevation cross-section view of the module shown in FIG. 1A, taken along line 1D—1D of FIG. 1B.

Referring more particularly to FIG. 1D, each panel 13,13' comprises an upper edge 31 and a lower edge 33. Preferably, one of these edges comprise a longitudinal tongue 35 while the other opposite edge comprises a longitudinal groove 37. In the illustrated embodiment of FIG. 1C, the longitudinal tongue 35 is on the upper edge 31 and the longitudinal groove 37 is in the lower edge 33. The tongue 35 and the groove 37 are sized to respectively co-operate with the groove and tongue of the identical or similar module stacked upon the said module to form a joint.

The bridging means 21 which is an essential part of the module 1, is best shown in FIGS. 1A and 1D. The bridging means 21 is connected to the reinforcing structure 11 and projects upwardly above the panels 13,13'. In the illustrated preferred embodiment, the bridging means 21 comprises arms 23 rigidly connected to the inwardly extending grids 17'. The arms 23 may simply consist of rods extending vertically. As shown in FIG. 1D, the arms 23 define a U-shaped trough sized and positioned to engage in a tight-fit manner a portion of at least one of the inwardly extending grids of the similar vertically stacked module (not shown). The bridging means 21 thus provides horizontal and vertical stability between the modules when assembled to form a wall.

When, as shown in FIGS. 1A and 1D, the formwork module 1 comprise two inwardly extending grids 17', the bridging means preferably comprises a junction grid rigidly connected to each of the two inwardly extending grids. The junction grids are made of parallel horizontal 25 and vertical 27 rows of wire or rods, all welded together. The junction grids incorporate the arms 23 and project upwardly above the panels 13,13' so as to define the U-shaped though which is thus sized and positioned to engage in a tight-fit manner the inwardly extending grids of the similar vertically stacked module (not shown).

Although not illustrated, the bridging means could also consist of a H-shaped metal structure devised to engage in a tight-fit manner a portion of at least one of the inwardly extending grids 17' of the module and a portion of at least one of the inwardly extending grids of a vertically stacked module. This H-shaped structure would be inserted to the top of the module before stacking the similar module.

Although neither illustrated, a person skilled in the art may easily visualise a module further comprising joining means rigidly connected to the reinforcing structure and projecting horizontally away from the panels. The joining means could be similar to the bridging means and would co-operate with the reinforcing structure of a similar adjacent module thereby providing an additional stability between the modules when assembled to form a wall.

Figure 2:
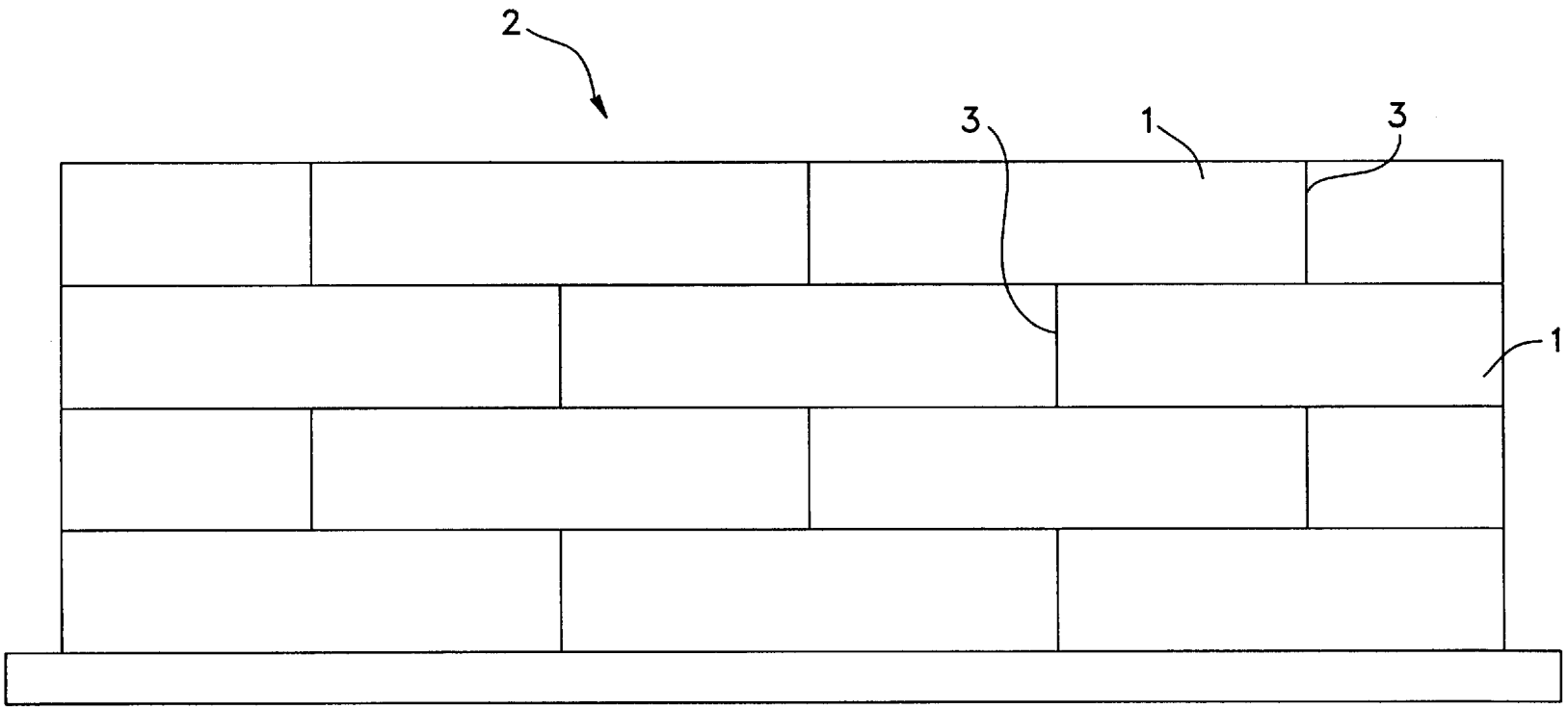
FIG. 2 is a front elevation view of a formwork wall made of assembled modules as shown in FIGS. 1A to 1D.

As shown in FIG. 2 a plurality of modules 1 according to the invention may be assembled together to form a wall 2. The illustrated wall 2 comprises four rows of horizontally aligned and vertically stacked modules 1. In use, a wall comprising modules of the invention stacked upon each other to a high equivalent to four floor building could be built without any problem. Obviously, the person skilled in the art will easily understand that buildings having more than four floors may be built by modifying accordingly the strength of the reinforcing structure of the modules (increasing the diameter and number of grids and rods for example). In order to provide a stronger wall 2, the stacked modules 1 are preferably offset with respect with each other such that there is no vertically aligned joint 3.

Figure 3:
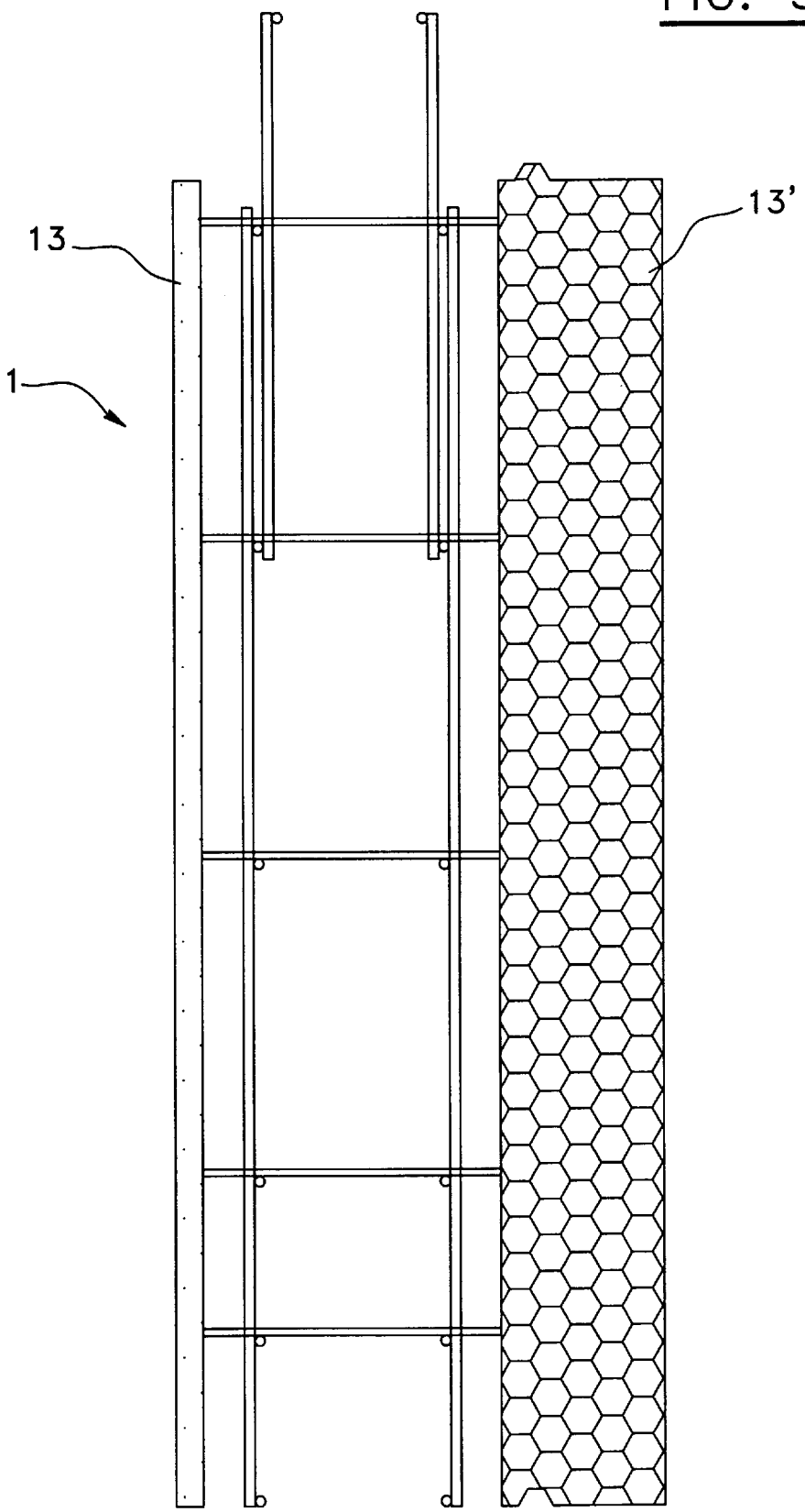
FIG. 3 is a side elevation view of a module according to another embodiment of the present invention, wherein one of the two panels forming the module is made of insulating material and the other panel is made of a composite material.

FIG. 3 shows a module 1 according to another embodiment of the invention wherein one of the panel 13 is made of a composite material, while the other panel 13' is made of a foam insulating material. The composite material includes PVC, concrete or polymers. In fact, any moldable material could be used. Modules wherein only one or both of the panels 13, 13' are made of a composite material will be heavier and more resistant than modules with panels made of foam. Such modules, with parts made of a composite material could be useful, by way of example, for manufacturing interior walls of a building. The thickness of the composite panels may vary from about ½ inch to about 2 inches, depending on the kind of composite material that is used.

Figure 4C:
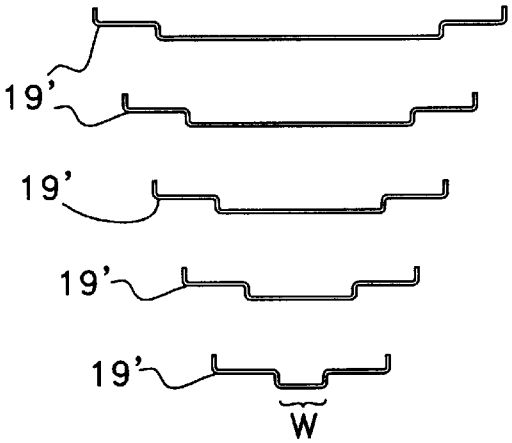
FIG. 4C is a view showing tie-rods of different sizes that may be used in the manufacture of the reinforcing structure shown in FIG. 4B.
Figure 4B:
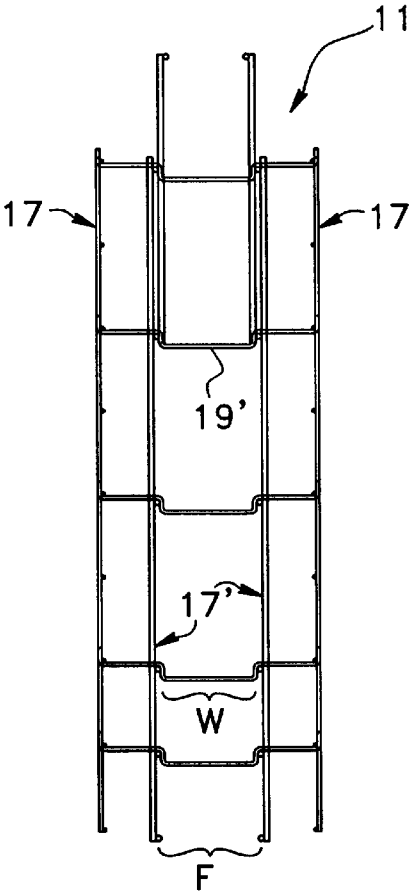
FIGS. 4A and 4B are side elevation views of two different embodiments of the reinforcing structure used in the module according to the invention.
Figure 4A:
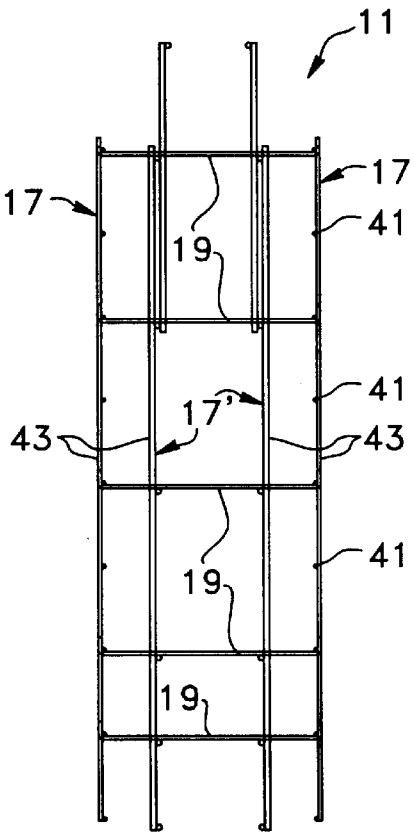

FIGS. 4A to 4C give more details relating the reinforcing structure 11. As shown on FIG. 4A, the grids 17, 17' are built according to normal procedures by welding together a plurality of parallel horizontal rows 41 and vertical rows 43 of metal wires. Although not illustrated, the grids 17, 17' could be wrinkled or undulated. As stated herein before, a plurality of tie-rods 19 extend transversely between the grids 17, 17' and are welded to the same in order to form a rigid unitary structure.

FIG. 4B shows another embodiment of reinforcing structure 11 comprising preshaped tie-rods 19'. As show in FIG. 4C, these preshaped tie-rods 19' comprises a central region W whose length depends on the requested width of the module. As shown in FIG. 4B, the length of the central region W is slightly inferior to the free space F existing between the inwardly extending grids 17'. The use of tie-rods 19' as shown in FIG. 4C may be advantageous for easily and rapidly manufacture the reinforcing structure of modules of different width.

Figure 5:
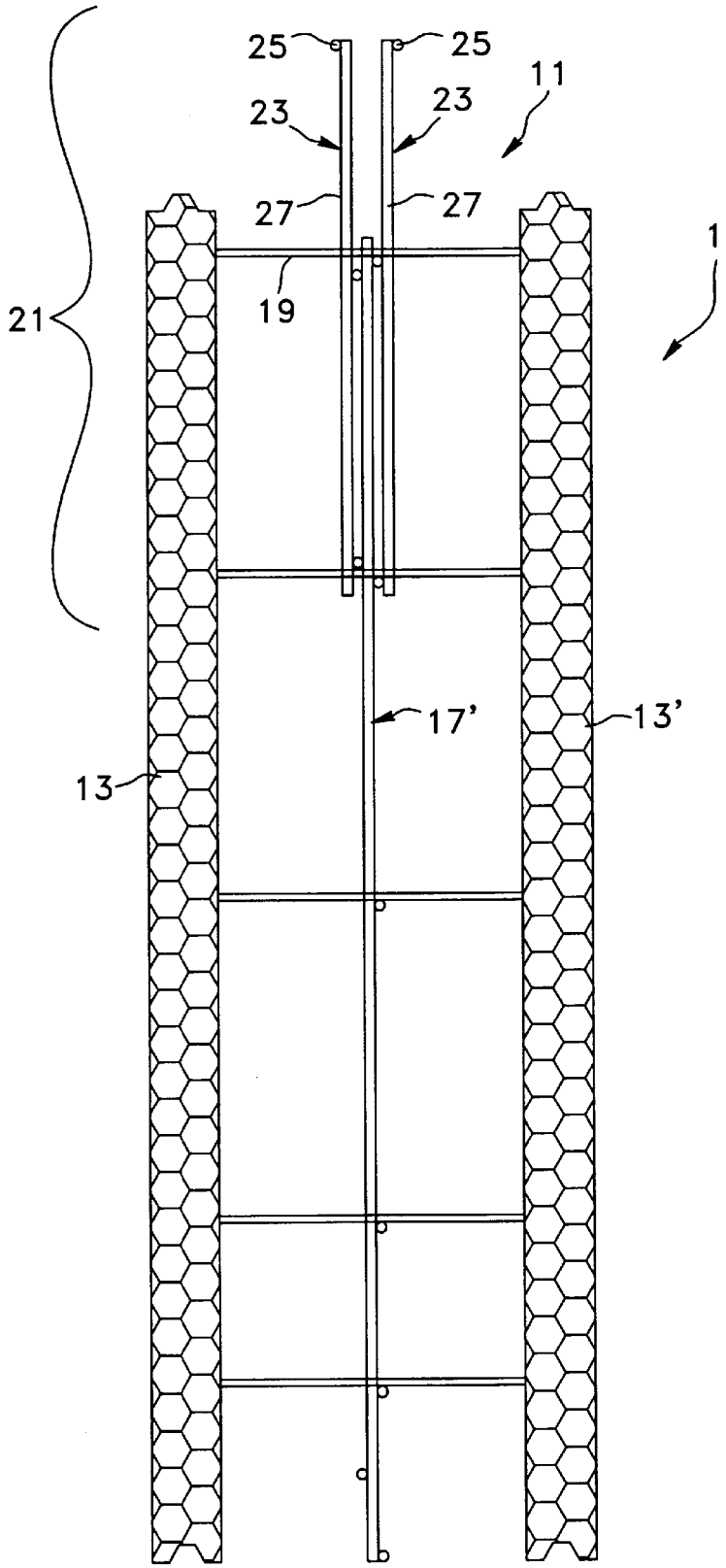
FIG. 5 is a side elevation view of a module according to a further embodiment of the invention comprising a reinforcing structure having only one inwardly extending grid.

Although in the previously illustrated embodiments, the reinforcing structure 11 comprises four parallel extending grids 17,17', the module 1 may be provided with more than four grids or with only three grids as shown in FIG. 5. In this illustrated embodiment, only one grid 17' extend inwardly between the panels 13,13'. In this FIG., the externally extending grids 17 are not shown since they are embodied into the panels 13,13'.

Like in the previous embodiment, the embodiment illustrated in FIG. 5 comprises bridging means 21 which is rigidly connected to the reinforcing structure 11 and projects upwardly above the panels 13,13'. In this preferred embodiment, the bridging means 21 comprises arms 23 rigidly connected to the inwardly extending grid 17'. The arms 23 may be rods extending vertically. However, they are preferably parts of a junction grid made of a plurality of parallel horizontal 25 and vertical 27 rows of metal wires welded all together. The arms 23 define with the upper tie-rod 19 a U-shaped trough sized and positioned to engage in a tight-fit manner a portion of the inwardly extending grid of a similar module (not shown) vertically stacked upon the illustrated module. The bridging means 21 thus provide horizontal and vertical stability between the modules when assembled to form a wall.

Since external elements may not be solidly fastened to foam panels and neither can they easily be fastened to the concrete once it is poured between the panels and it has hardened, it may be advantageous to provide formwork module according with at least one fixation plate integral to the module. Such a fixation plate would provide a support onto which external elements could be easily and rigidly fastened.

Figure 6A:
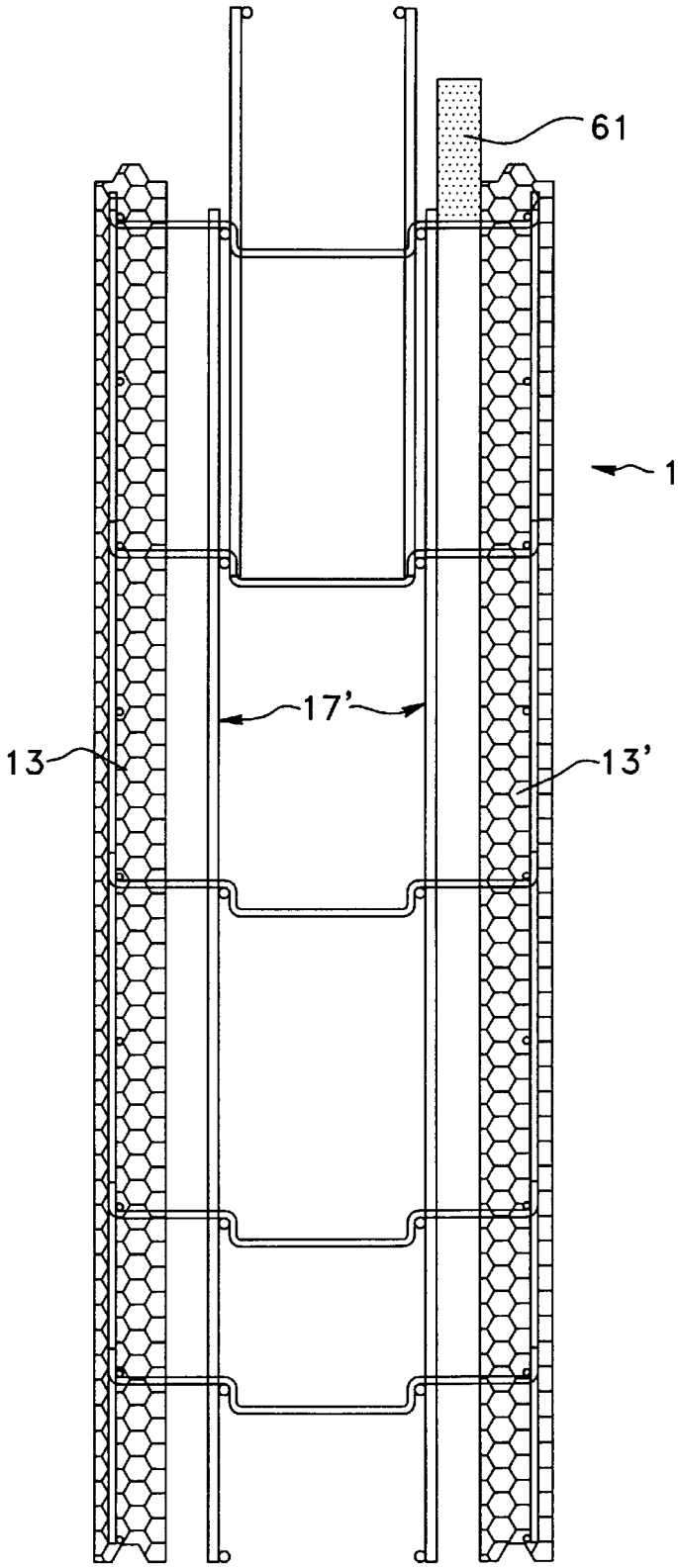
FIGS. 6A, 6B and 6C are side elevation cross-section views of three different embodiments of an optional fixation plate that can be used with the module of the invention.

FIG. 6A shows a first embodiment of fixation plate. The plate 61 consists of a piece of wood or of a composite material (such as plastic) inserted between one of the inwardly extending grids 17' and one of the two panels 13,13'. Of course, the plate must be inserted within the module 1 adjacent to the side wall when elements are to be fixed before concrete is poured in the module.

Figure 6B:
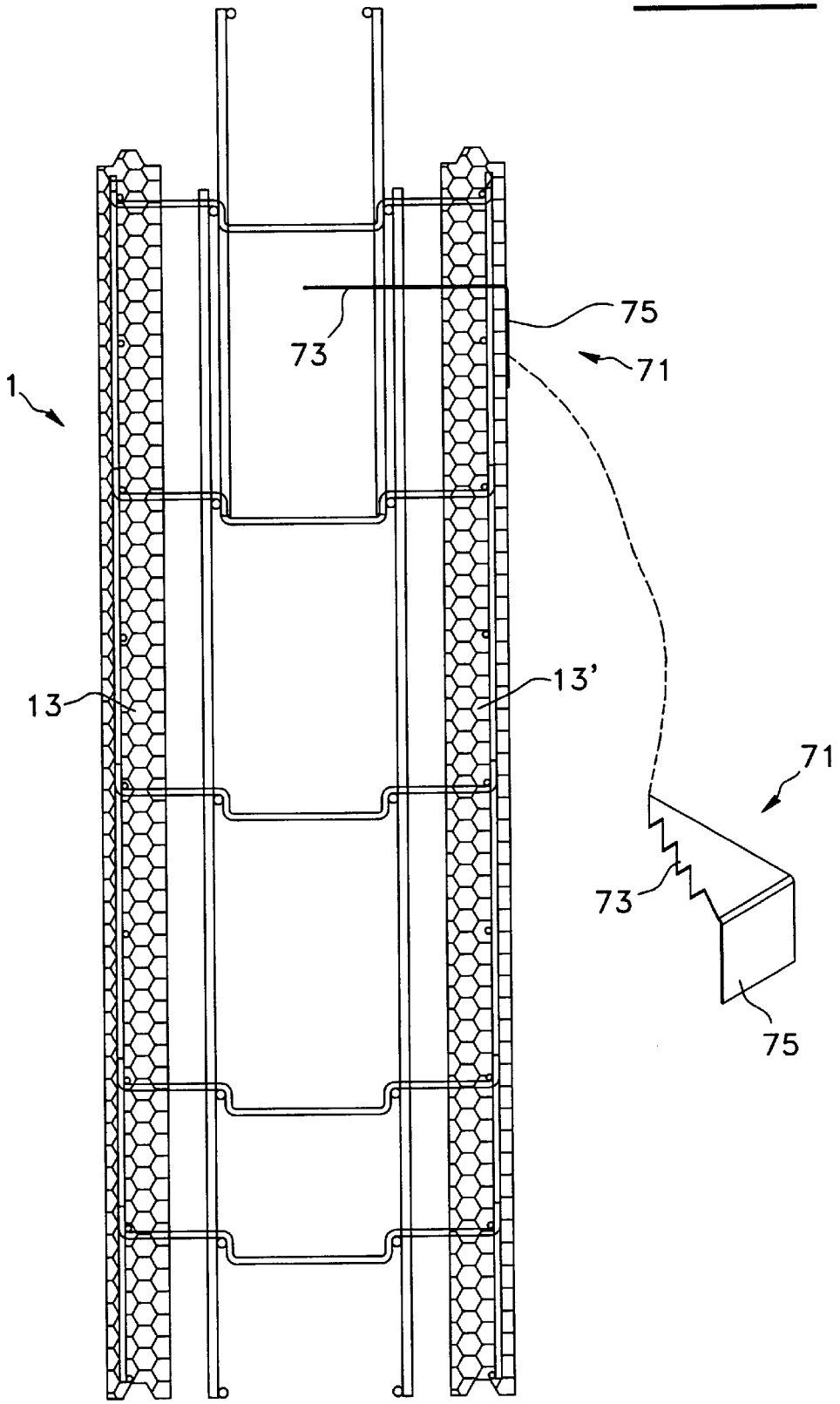

FIG. 6B shows a second embodiment of fixation plate. In this embodiment, the plate consists of a L-shaped metal sheet 71. As shown, the metal sheet 71 has an horizontal longitudinal portion 73 and a perpendicular vertical portion 75 providing the support onto which external elements may be fastened. The sheet 71 is fixed to the module 1 by pushing its horizontal portion 73 into one of the panels 13,13' before concrete is poured into the module 1. As shown on the perspective view, the horizontal portion 73 of the sheet 71 is preferably triangular in shape and provided with a plurality of retaining teeth.

Figure 6C:
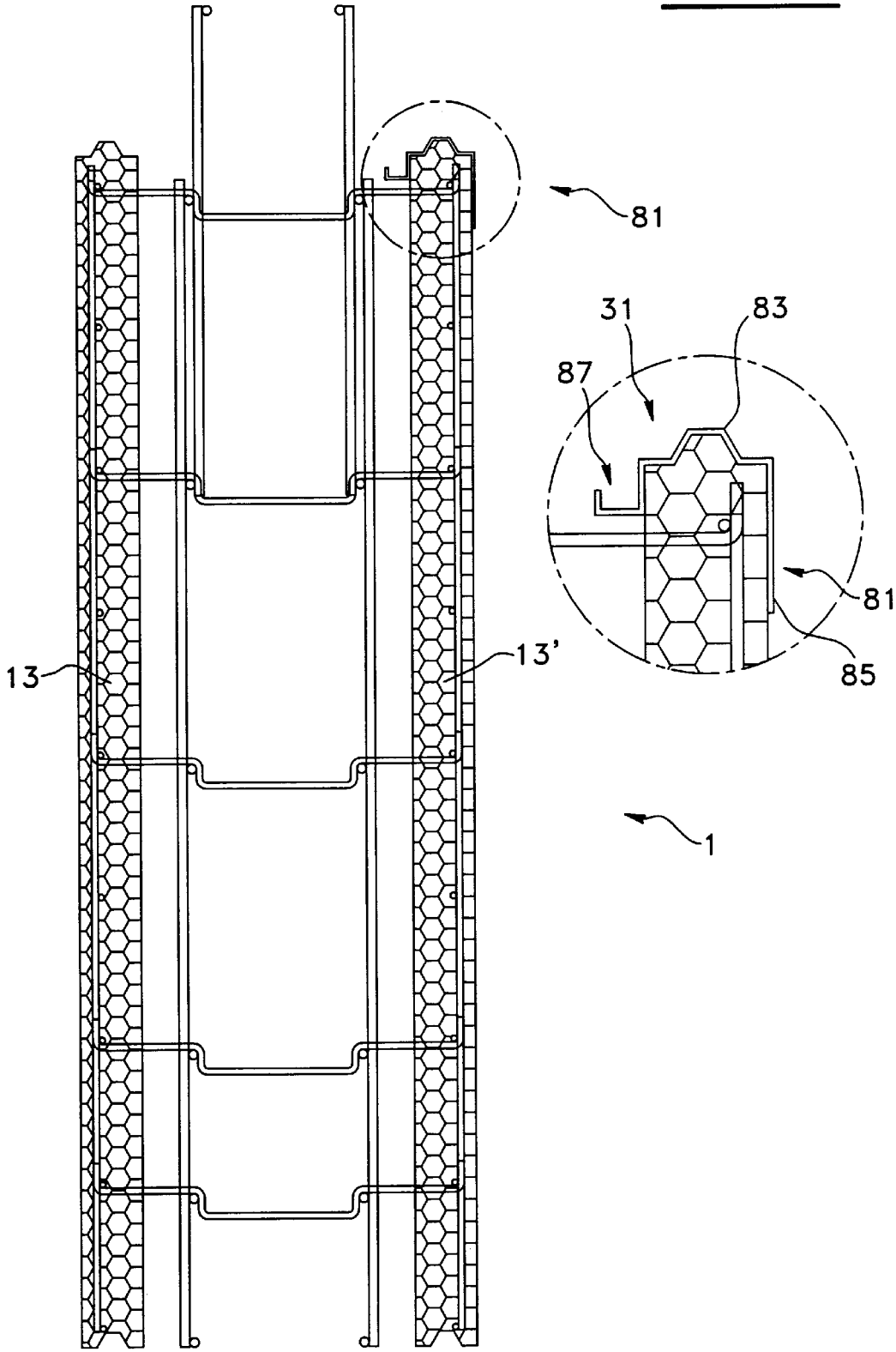

FIG. 6C shows a third embodiment of fixation plate. As best shown in the enlargement, the plate consists of a L-shaped sheet 81 having an horizontal longitudinal portion 83 mounted over an upper edge 31 of one of the panels 13,13' and shaped to fit onto this upper edge 31. The sheet 81 also has a perpendicular vertical portion 85 providing the support onto which external elements may be fastened. The sheet 81 may be mounted over the upper edge 31 such that the perpendicular vertical portion 85 is located on the outside or the inside of the panel 13'.

Preferably, the sheet 81 is mounted on the outside the panel 13' and the horizontal portion 83 the sheet 81 further comprises a U-shaped edge 87 located within the module 1. As shown in FIG. 6C, the edge 87 has a first vertical section co-operating in a tight fit manner with an internal portion of the panel 13'. The edge 87 also has an horizontal section and a second vertical section providing anchor means that will become integral to the module 1 once the concrete will be poured into the module.

Of course, numerous modifications and improvements could be made to the embodiments that have been disclosed hereinabove. These modifications and improvements should, therefore, be considered a part of the invention, the scope of which is to be determined by the following claims.

I claim:

1. A formwork module for forming a concrete wall, said module comprising:

a reinforcing structure comprising:

at least three metal grids extending in parallel vertical relationship, said grids being spaced apart from each other with two of said grids extending externally, every other one of said grids extending inwardly between said externally extending grids; and a plurality of tie-rods extending transversely to said grids; said grids and tie-rods being rigidly connected to each other and altogether forming a unitary structure;

a pair of opposite panels extending in parallel vertical planes, each of said opposite panels embodying one of said two externally extending grids and forming therewith a longitudinal side-wall, said side walls being spaced apart and facing each other in parallel relationship; and bridging means connected to said reinforcing structure and projecting upwardly above said panels, said bridging means co-operating with the reinforcing structure of a similar module stacked upon the said module for providing stability between said modules when assembled to form a wall.

2. The formwork module of claim 1, wherein the bridging means comprises arms rigidly connected to at least one of said inwardly extending grids, said arms defining a U-shaped trough sized and positioned to engage in a tight-fit manner, at least one of the inwardly extending grids of the similar vertically stacked module stacked upon the said module, whereby horizontal and vertical stability are provided between said modules when assembled to form a wall.

3. The formwork module of claim 2, comprising two of said inwardly extending grids and wherein said bridging means comprise a junction grid rigidly connected to each of said inwardly extending grids, said junction grids incorporating said arms and projecting upwardly above said panels so as to define said U-shaped trough which is thus sized and positioned to engage in a tight-fit manner the inwardly extending grids of a similar module stacked upon said module.

4. The formwork module of claim 1, further comprising joining means rigidly connected to said reinforcing structure, said joining means projecting horizontally away from said panels and co-operating with the reinforcing structure of a similar adjacent module for providing stability between said modules when assembled to form a wall.

5. The formwork module of claim 1, wherein said panels have an identical length and are horizontally offset with respect to each other.

6. The formwork module of claim 1, comprising two of said inwardly extending grids, said inwardly extending grids having an identical length and being horizontally offset with respect to each other.

7. The formwork module of claim 1, wherein each of said panels comprises an upper edge and a lower edge, one of these edges comprising a longitudinal tongue while the other edge comprises a longitudinal groove, said tongue and groove being sized to co-operate respectively with the groove and tongue of the similar module stacked upon the said module to form a joint.

8. The formwork module of claim 1, wherein at least one of said grids is wrinkled or undulated.

9. The formwork module of claim 1, wherein said externally extending grids are embodied into said panels, thereby forming a core within said panels.

10. The formwork module of claim 1, wherein at least one of said panels is made of an insulating material.

11. The formwork module of claim 10 wherein both of said panels are made of an insulating material.

12. The formwork module of claim 1, wherein at least one of said panels is made of a composite material.

13. The formwork module of claim 1, further comprising at least one fixation plate integral to the module once the concrete wall is formed, said at least one plate providing a support onto which external elements may be fastened.

14. The formwork module of claim 13, wherein the fixation plate comprises a piece of wood or a composite material inserted between the inwardly extending grid(s) and one of said panels.

15. The formwork module of claim 13, wherein the fixation plate comprises a L-shaped metal sheet, said metal sheet having a horizontal longitudinal portion and a perpendicular vertical portion providing the support onto which external elements may be fastened, said horizontal portion being pushed into one of said panels.

16. The formwork module of claim 15, wherein the horizontal portion is triangularly shaped and provided with a plurality of retaining teeth.

17. The formwork module of claim 13, wherein the fixation plate comprises a L-shaped sheet, said sheet comprising a horizontal longitudinal portion mounted over an upper edge of one of said panels and a perpendicular vertical portion providing said support onto which external elements may be fastened, said horizontal portion being shaped to fit on said upper edge.

18. The formwork module of claim 17, wherein the horizontal portion of the sheet has a U-shaped edge located within said module, said edge having a first vertical section co-operating in a tight fit manner with an internal portion of said panel, a horizontal section and a second vertical section providing anchor means integral to the module once the concrete wall is formed.

19. A formwork module for forming a concrete wall, said module comprising:

a reinforcing structure comprising:

four metal grids extending in parallel vertical relationship, said grids being spaced apart from each other with two of said grids extending externally, the other two of said grids extending inwardly between the two externally extending grids; and a plurality of tie-rods extending transversely to said grids; said grids and tie-rods being rigidly connected to each other and altogether forming a unitary structure;

a pair of opposite panels extending in parallel vertical planes, each of said opposite panels embodying one of said two externally extending grids and forming therewith a longitudinal side-wall, said side walls being spaced apart and facing each other in parallel relationship; and bridging means connected to said reinforcing structure and projecting upwardly above said panels, said bridging means comprising a junction grid rigidly connected to each of the two inwardly extending grids, said junction grids projecting upwardly above said panels so as to define a U-shaped trough sized and positioned to engage in a tight-fit manner the two inwardly extending grids of a similar vertically stacked module stacked upon the said module, whereby horizontal and vertical stability are provided between said modules when assembled to form a wall.

20. The formwork module of claim 19, wherein said panels have an identical length, are horizontally offset with respect to each other and are made of an insulating material, and wherein the externally extending grids are embodied into said panels thereby forming a core within said panels, each of said panels comprising an upper edge and a lower edge, one of these edges comprising a longitudinal tongue while the other edge comprises a longitudinal groove, said tongue and groove being sized to co-operate respectively with the groove and tongue of the similar module stacked upon the said module to form a joint.

* * * * *